US005104235A

United States Patent [19]

Brönstrup et al.

[11] Patent Number: 5,104,235

[45] Date of Patent: Apr. 14, 1992

[54] PACKING CONTAINER MADE FROM A FLEXIBLE MATERIAL IN THE FORM OF A SACK OR BAG

[75] Inventors: Hans J. Brönstrup; Klaus Huckriede, both of Lengerich; Norbert Kötter, Tecklenburg, all of Fed. Rep. of Germany

[73] Assignee: Bischof und Klein GmbH & Co., Lengerich, Fed. Rep. of Germany

[21] Appl. No.: 625,198

[22] Filed: Dec. 10, 1990

[30] Foreign Application Priority Data

Dec. 13, 1989 [DE] Fed. Rep. of Germany ..... 8914623

[51] Int. Cl.[5] ..... B65D 30/12; B65D 30/20; B65D 30/24; B65D 33/38

[52] U.S. Cl. ..... 383/10; 383/41; 383/54; 383/66; 383/67; 383/120; 383/906; 383/907

[58] Field of Search ..... 383/10, 120, 907, 54, 383/906, 66, 67, 41

[56] References Cited

U.S. PATENT DOCUMENTS

| | | | |
|---|---|---|---|
| 1,410,404 | 3/1922 | Haines | 383/10 |
| 1,415,450 | 5/1922 | Johnson | 383/120 |
| 1,451,652 | 4/1923 | Eisenhart | 383/10 |
| 1,973,956 | 9/1934 | Hickman | 383/120 |
| 2,201,675 | 4/1940 | Vogel-Jorgensen | 383/54 |
| 3,237,534 | 3/1966 | Lissner | 383/54 |
| 3,690,221 | 9/1972 | Schmedding | 383/10 |
| 4,243,171 | 1/1981 | Prin | 383/120 |
| 4,966,286 | 10/1990 | Muckenfuhs | 383/120 |

FOREIGN PATENT DOCUMENTS

| | | | |
|---|---|---|---|
| 1141841 | 2/1969 | United Kingdom | 383/10 |

*Primary Examiner*—Stephen P. Garbe
*Attorney, Agent, or Firm*—Jordan and Hamburg

[57] ABSTRACT

A packaging container made of flexible material has bottom and head ends along with front and rear walls. The front and rear walls have lower side borders juxtaposed to the bottom end and which are joined together along juncture fold lines which are parallel to one another. The front and rear walls have upper side borders juxtaposed to the juncture fold lines. The upper side borders of the front and rear walls are connected by side panels having outer fold lines at the second side borders and an inner fold line such that when the container is in a flat unfilled state, the side panels are sandwiched between the front and rear walls and the outer fold lines and inner fold lines respectively converge toward one another as the head end is approached.

9 Claims, 2 Drawing Sheets

PACKING CONTAINER MADE FROM A FLEXIBLE MATERIAL IN THE FORM OF A SACK OR BAG

The invention relates to a packing container made from flexible material in the form of a sack or bag with a bottom end and a head end, as well as with a front wall and a rear wall, which in the empty state of the packing container lie flat against one another and are connected to one another at their side borders by way of folded edges, the side borders having in the region of the bottom end a course, in which they are aligned parallel to one another and, in a region extending from this bottom end to the head end, a course in which they converge towards one another.

Packing containers of this type have already become known, for example, in the form of carrying bags, which are distinguished by the fact that the holding capacity of the carrying bag increases towards the bottom, since the bottom region, owing to the parallel course of the side borders of the bag, is the widest, while there is a constriction in the width of the bag towards the head end of the bag. At the same time, such a refinement prevents a bulging of the bag, which consists of a flexible material, and improves the stability under load.

It is an object of the invention to provide a packing container of the given type with an increased holding capacity and with a well contoured packing shape in the filled state, without complicating the construction of the bottom end and without increasing the space required for the packing container in the empty state.

Starting out from a packing container of a flexible material in the form of a sack or a bag of the type initially given, this objective of the invention is accomplished owing to the fact that a side fold is inserted at each of the side borders between the front wall and the rear wall. This side fold extends over the converging region of the side borders. The inner folded edge of this side fold is disposed as an extension of the associated side border folded edge of the parallel region of the side borders.

In the case of this refinement, the holding capacity, for the bag contour given when the packing container is in the empty state, is increased owing to the fact that the side folds are spread apart flat and pushed to the outside during the filling process. By these means and under participation of the pronounced outer folded edges of the side folds, the packing container, moreover, receives a distinct outer contour, which is approximately rectangular in cross section. This endows the packing with an optically pleasing appearance and facilitates the stacking of the filled packing container, as well as its handling in use. The space required by the packing container in the empty state is not increased because of the material lying between the front and rear walls of the side folds, so that space is saved when the packing container is shipped or stored.

Complications in the construction of the bottom end by the inserted side folds are avoided in the inventive embodiment owing to the fact that the side folds do not extend up to the bottom edge, but instead end at a distance above this edge. The bottom region, with its side borders aligned parallel to one another, can therefore be worked on with little expense in a manner customary for sack or bag tube pieces without side folds to form a suitable bottom seal. This bottom seal may, for example, be a well-known cross bottom, in which a filling valve may be incorporated for filling the packing container from the bottom end. Instead of this, the bottom end can be constructed so as to be initially open for filling the packing container. After the filling process, the bottom end is then closed off by a folding or rolled up bottom, etc. In any case, a good stability under load of the filled packing container is achieved due to the construction of the bottom and in conjunction with the bottom region, which is cuboid in shape in the filled state of the packing container. The part of the packing container, which is connected to the bottom, tapers towards the head end and approximately has the shape of a truncated cone, offers increased, carrying comfort in conjunction with the head end of the packing container, which is constructed as a carrying part, preferably, for example, by means of a stamped-out handle opening.

Numerous further charactistics and advantages arise out of the claims and the specification below in conjunction with the drawing, which illustrates diagrammatically two embodiments of the object of the invention.

DESCRIPTION OF THE PREFERRED EMBODIMENTS

Figure 1:
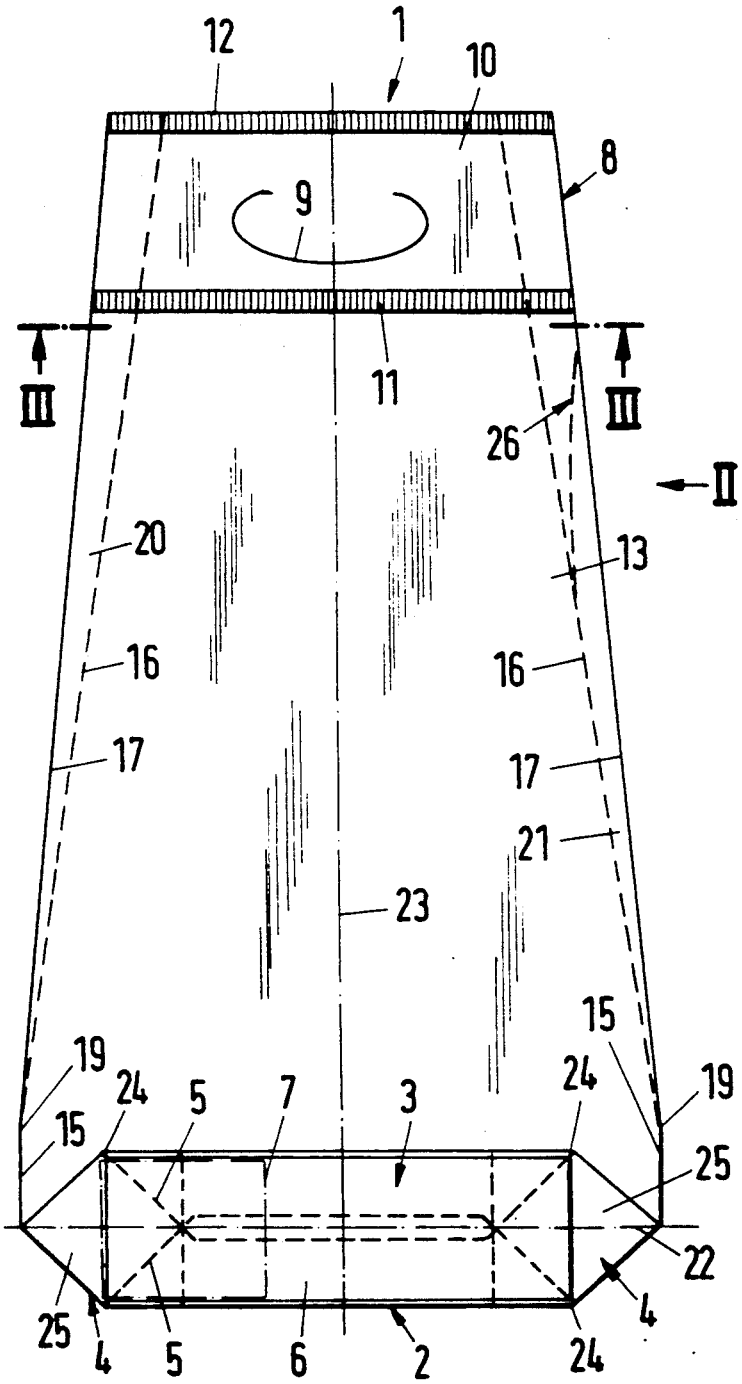
FIG. 1 shows a front view of the inventive packing container in the empty state.

The packing container, which is shown in the drawing and, as a whole, is labeled 1, may consist of any suitable, flexible or foldable material, such as those used for the manufacture of sacks or bags. In particular, suitable material are paper, plastic film, laminates or woven fabric, such as plastic tape fabric, in a single layer or multilayer construction. In the example shown, the packing container 1 has a single layer construction and consists, for example, of a plastic-coated paper. The material bonds, to produce the bag-shaped or sack packing container, can be formed by welded or glued seams.

As is evident, to begin with from FIG. 1, the packing container 1 has a cross bottom 3, which closes off the bag tube at the bottom end 2 and comprises, in the usual manner, corner tucks 4 and bottom side cuffs 5, which lie opposite one another in pairs and overlap in the center of the bottom, as well as an outer, bottom covering sheet 6. For filling the packing container 1 from the bottom end 2, the cross bottom 3 is provided with a filling valve 7, which is constructed in a known manner as an internal valve that closes automatically under the pressure of the material filled into the packing container or may have any other suitable construction.

Figure 2:
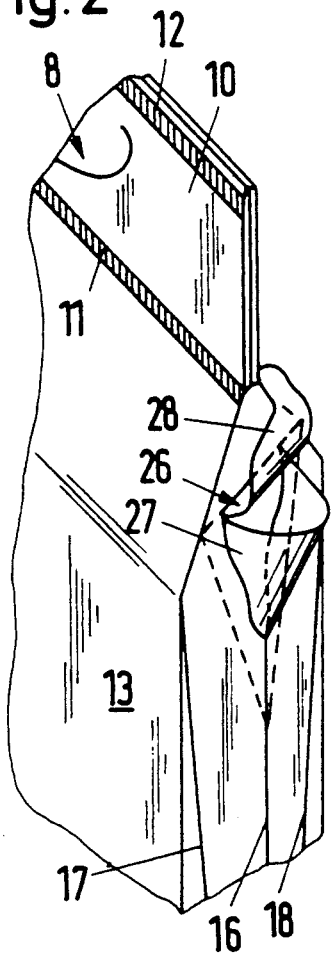
FIG. 2 shows a perspective view of the upper end region of the packing container of FIG. 1 in direction of arrow II, an offtake device for pourable filling material, which is contained in the filling space of the packing container, being shown in the opened state.

By means of a punch-in handle hole 9, the head end 8 of the packing container 1 forms a carrying part 10, which is separated from the filling space of the packing container by a cross seam 11. The filling space thus occupies the space between the cross bottom 3 and the cross seam 11. The upper, outer end forms a cross seam 12, which extends, as does the cross seam 11, over the whole width of the packing In the empty state of the packing container 1, as can be seen in FIGS. 1 and 2, the front wall 13 and the rear wall 14 of the bag tube lie flat against one another and are connected at their two side borders by means of folded edges 15 or 16, 17 and 18. In their region adjoining the cross bottom 3, the side borders of the bag tube follow with their folded edges 15 a course in which they are aligned parallel to one another. From a point 19 onwards, the side borders of the bag tube follow with their folded edges 16, 17, 18 a course, in which they converge up to their head end 8. In so doing, the folded edges 16, 17, 18 each define a side fold 20 or 21 in the converging region of the side borders and the inner folded edge 16 of the side folds 20 or 21 is disposed as an extension of the folded edge 15 of the parallel region of the side borders.

Figure 3:
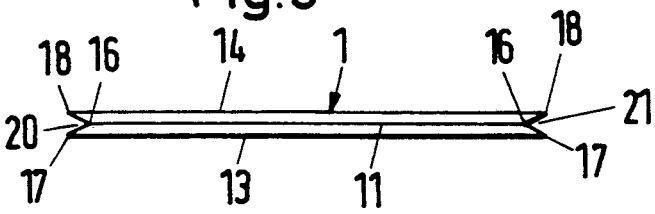
FIG. 3 shows a section along the line III—III of FIG. 1

The conveying region of the side borders with the side folds 20 and 21 is limited to the upper two thirds of the height of the packing container 1 and, for the embodiment shown in FIGS. 1 to 3, lies at a distance, which corresponds approximately to the width of the cross bottom 3, from the bottom plane 22, which is drawn as a dot-dash line in FIG. 1 and which the cross bottom 3 occupies in the filled state of the packing container 1 with a deflection through 90° from the front wall 13, against which the cross bottom 3 lies with one half in the empty state.

As can be seen particularly from FIG. 1, the inner folded edge 16 of the side folds 20 and 21 is more inclined to the longitudinal center plane 23 of the packing container 1 than are the associated outer folded edges 17, 18 of the respective side fold 20 or 21. The depth of insertion of each side fold 20, 21 increases uniformly from its starting point 19 and reaches its maximum valve at the end seam 12 of the head end 8, through which the two side folds 20, 21 continue. In the region of the head end 8, however, the side folds 20, 21 are welded flat together and exert no effect on the spatial shape of the filled packing container, as is evident from FIG. 2. The flat spreading apart of the side folds 20 and 21 is limited to the filling space of the packing container 1 and takes place under the pressure of the material filled through the filling valve 7. In order to form a responding, approximately pyramidal packing, the depth of insertion of the side folds 20, 21 in the region adjoining the transverse seam 11 has the dimensions corresponding approximately to half the width of the cross bottom 3, Alternatively, the depth of insertion of the side folds 20, 21 at the end seam 12 corresponds approximately to half the width of the cross-bottom 3.

The base of the filled packing container 1 has a rectangular contour, which is defined by corner points 24 of the bottom side cuffs 5 of the cross bottom 3. Said corner points 24 lie opposite one another in pairs. While the packing container is being filled, the outer apexes of the triangles 25 fold into the side areas of the packing container, which are being formed. Said side areas, moreover, include the side folds 20 and 21, which are spread apart flat, with the V-shaped, outer folded edges 17, 18, which lead into the starting points 19. To achieve a packing container in the shape of a truncated pyramid, the length of the cross seam 11, which closes off the filling space, is shorter in the region above the starting points 19 for the side folds than the length of the rectangular base of the packing container formed by the cross bottom 3. To the extent that the length of the cross seam 11 approaches the length of the cross bottom 3 or the base defined by this cross bottom 3, the more is it likely that a prismatic or cuboid shape is formed in this region in the filled state of the packing container.

In the filled state of the packing, the inserted side folds 20, 21, as a result of their being spread apart flat and with their outer folded edges 17 and 18, bring about side areas of stabilized shape between the front wall 13 and the rear wall 14. The transverse dimension between the folded edges 17 and 18 in the region adjoining the cross seam 11 defines planar zones of such a size, that an offtake device 26 with an outlet part 27 for the pourable material contained in the filling space can readily be provided in one of the two side folds (in side fold 21 in the example shown here). In the example shown, the offtake device 26 consists of a flap of material 28, which can be separated partially from the material of the side fold 21 and flipped up, and of a flexible planar material cutting, which is fixed at the inside of the packing container in the region of the side fold 21 and, when needed and after the flap of material 28 has been severed and flipped up, can be pulled out of the filling space and then forms the outlet part 27 in the form of a chute.

Figure 4:
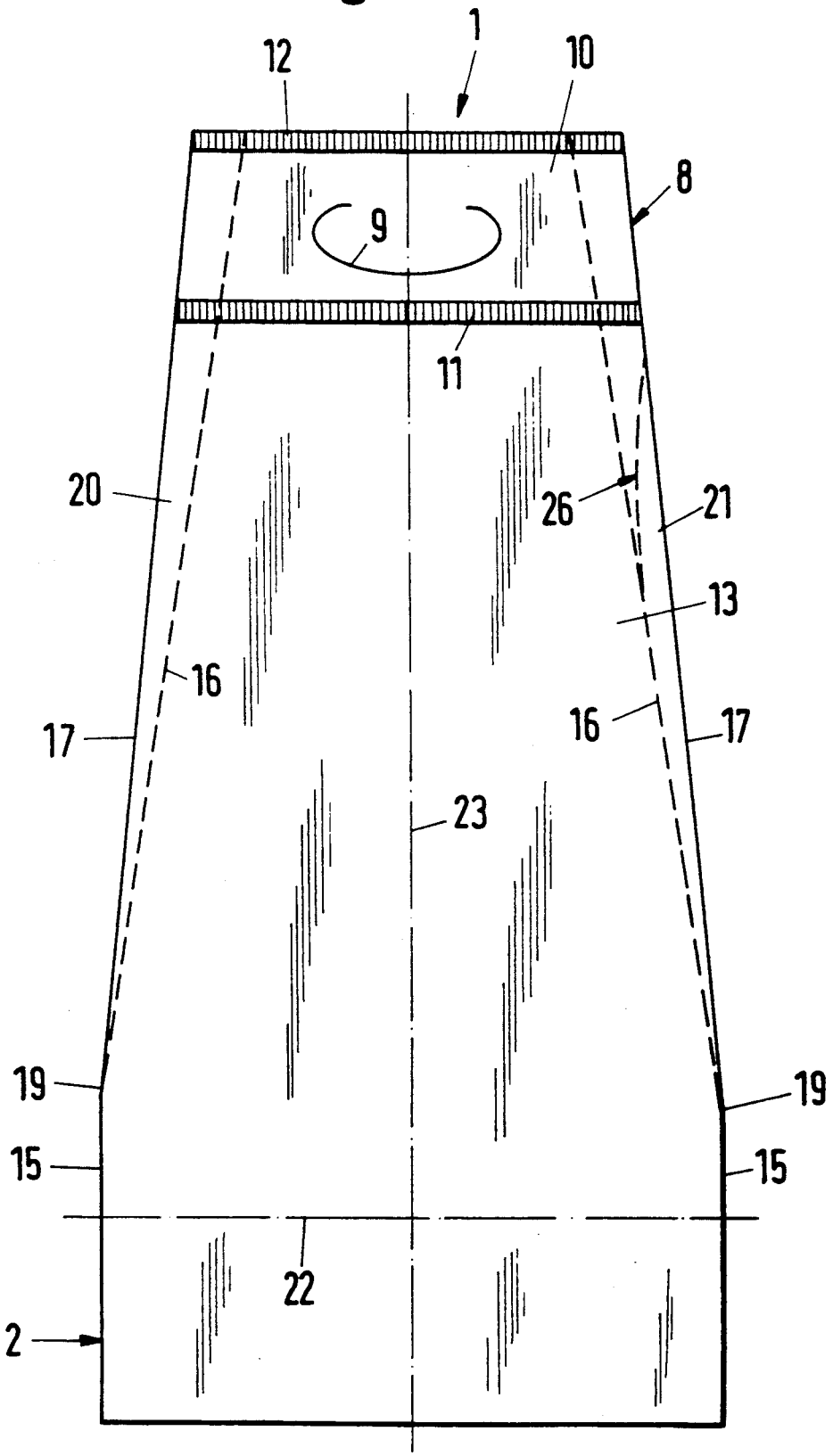
FIG. 4 shows a representation corresponding to FIG. 1 to illustrate a modified embodiment.

In the embodiment of FIG. 4, the bottom end 2 is constructed to be open initially for filling the packing container. After the filling process is conducted through the open end of the bottom 2, the bottom end 2 can be closed off as part of the filling process by a simple folded, rolled up or similar bottom, without the formation of the bottom being complicated by the side folds 20 and 21. When the packing container 1 is filled and placed on a flat support, the closed bottom end 2 forms a base in the plane of the bottom, which is drawn once again at 22 with dashes and dots. In other respects, this embodiment agrees with that of FIG. 1 to 3, as is also made evident by the use of the same reference symbols for the corresponding or identical parts.

What is claim is:

1. A packaging container made of flexible material and having a flat unfilled state, said container having bottom and head ends along with front and rear walls, said front and rear walls having lower side borders juxtaposed to said bottom end and which are joined together along juncture fold lines which are parallel to one another, said front and rear walls having upper side borders juxtaposed to said juncture fold lines, said upper side borders of said front and rear walls being connected by side panels having outer fold lines at said upper side borders and an inner fold line, said side panels being sandwiched between said front and rear walls, said outer fold lines and inner fold lines respectively converging toward one another as said head end is approached, said bottom end being a flat cross-bottom, and a filling valve means incorporated into said cross-bottom for filling said container.

2. A packaging container according to claim 1, wherein said container has a height which extends between said head and bottom ends, side upper side borders being at least two-thirds of said height.

3. A packaging container according to claim 1, wherein said bottom end has a flat cross-bottom extending parallel to the front and rear walls, said flat cross-bottom having spaced parallel joiner lines, said front wall being joined to said cross-bottom at one of said joiner lines, said rear wall being joined to said cross-bottom at the other of said joiner lines, the distance between said joiner lines constituting the width of said cross-bottom, said inner fold lines joining the respective juncture fold lines at respective intersections, said inner fold lines extending from the respective intersections to respective terminating ends at said head end, said upper side borders having respective terminating ends at said head end, said terminating ends of said inner fold lines being spaced from from respective terminating ends of said upper side border a distance which which is approximately equal to one-half the width of said cross-bottom.

4. A packaging container according to claim 1, wherein said bottom end has a flat cross-bottom, said bottom end being a flat cross-bottom extending parallel to the front and rear walls, said flat cross-bottom having spaced parallel joiner lines, said front wall being joined to said cross-bottom at one of said joiner lines, said lines, said rear wall being joined to said cross-bottom at the other of said joiner lines, the distance between said joiner lines constituting the width of said cross-bottom, said head end having a terminating end and a cross-seam spaced from said terminating end, the space between said terminating end and said cross-seam defining a carrying section which is separated from a filling space of said container by said cross-seam, said side panels extending through said carrying section, said inner fold lines joining the respective juncture fold lines at respective intersections, said inner fold lines extending from said respective intersection at least to said cross-seam, said cross-seam intersecting said inner fold lines at cross-seam intersects, said cross-seam having terminating ends at the respective side border, said cross-seam terminating ends being spaced from the respective cross-seam intersect a distance which is approximately equal to one-half the width of said cross-bottom.

5. A packaging container according to claim 1, wherein said bottom end has a flat cross-bottom, said bottom end being a flat cross-bottom extending parallel to the front and rear walls, said flat cross-bottom having spaced parallel joiner lines, said front wall being joined to said cross-bottom at one of said joiner lines, said rear wall being joined to said cross-bottom at the other of said joiner lines, the distance between said joiner lines constituting the width of said cross-bottom, said flat cross-bottom having a transverse center line parallel to said joiner lines and which generally bisects said flat cross-bottom, said juncture fold lines having bottom ends terminating at said transverse center line, said juncture fold lines each having a length approximately equal to the width of said cross-bottom.

6. A packaging container made of flexible material and having a flat unfilled state, said container having bottom and head ends along with front and rear walls, said front and rear walls having lower side borders juxtaposed to said bottom end and which are joined together along juncture fold lines which are parallel to one another, said front and rear walls having upper side borders juxtaposed to said juncture fold lines, said upper side borders of said front and rear walls being connected by side panels having outer fold lines at said upper side borders and an inner fold line, said side panels being sandwiched between said front and rear walls, said outer fold lines and inner fold lines respectively converging toward one another as said head end is approached, one of said side panels being provided with an off-take means for pouring out the contents of the container, said off-take means comprising a flap part, said one side panel having an opening which is closed by said flap part, said flap part being at least partially separable from said panel to expose said opening, said off-take means further comprising a flexible material part which is fixed to the inside of said one side panel and disposed within said container, whereby said flexible material part is withdrawable from said opening in said one side panel to form a pouring spout upon said flap part being at least partially separated from said panel to expose said opening.

7. A packaging container made of flexible material and having a flat unfilled, state, said container having bottom and head ends along with front and rear walls, said front and rear walls having lower side borders juxtaposed to said bottom end and which are joined together along juncture fold lines which are parallel to one another, said front and rear walls having upper side borders juxtaposed to said juncture fold lines, said upper side borders of said front and rear walls being connected by side panels having outer fold lines at said upper side borders and an inner fold line, said side panels being sandwiched between said front and rear walls, said outer fold lines and inner fold lines respectively converging toward one another as said head end is approached, said container being in a flattened condition and having an open bottom end.

8. A packaging container made of flexible material and having a flat unfilled state, said container having bottom and head ends along with front and rear walls, said front and rear walls having lower side borders juxtaposed to said bottom end and which are joined together along juncture fold lines which are parallel to one another, said front and rear walls having upper side borders juxtaposed to said juncture fold lines, said upper side borders of said front and rear walls being connected by side panels having outer fold lines at said upper side borders and an inner fold line, said side panels being sandwiched between said front and rear walls, said outer fold lines and inner fold lines respectively converging toward one another as said head end is approached, said bottom end being a flat cross-bottom extending parallel to said front and rear walls, said flat cross-bottom having spaced parallel joiner lines, said front wall being joined to said cross-bottom at one of said joiner lines, said rear wall being joined to said cross-bottom at the other of said joiner lines, the distance between said joiner lines constituting the width of said cross-bottom, said inner fold lines joining the respective juncture fold lines at respective intersections, said inner fold lines extending from the respective intersections to respective terminating ends at said head end, said upper said borders having respective terminating ends at side head end, said terminating ends of said inner fold lines being spaced from respective terminating ends of said upper side border a distance which is approximately equal to one-half width of said cross-bottom.

9. A packaging container made of flexible material and having a flat unfilled state, said container having bottom and head ends along with front and rear walls, said front and rear walls having lower side borders juxtaposed to said bottom end and which are joined together along juncture fold lines which are parallel to one another, said front and rear walls having upper side borders juxtaposed to said juncture fold lines, said upper side borders of said front and rear walls being connected by side panels having outer fold lines as said upper side borders and an inner fold line, said side panels being sandwiched between said front and rear walls, said outer fold lines and inner fold lines respectively converging toward one another as said head end is approached, said bottom end being a flat cross-bottom extending parallel to the front and rear walls, said flat cross-bottom having spaced parallel joiner lines, said front wall being joined to said cross-bottom at one said joiner lines, said rear wall being joined to said cross-bottom at the other of said joiner lines, the distance between said joiner lines constituting the width of said cross-bottom, said head end having a terminating end and a cross-seam spaced from said terminating end, the spaced between said terminating end and said cross-seam defining a carrying section which is separated from a filling space of said container by said cross-seam, said side panels extending through said carrying section, said inner fold lines joining the respective juncture fold lines at respective intersections, said inner fold lines extending from said respective intersection at least to said cross-seam, said cross-seam intersecting said inner fold lines at cross-seam intersects, said cross-seam having terminating ends at the respective side border, said cross-seam terminating ends being spaced from the respective cross-seam intersect a distance which is approximately equal to one-half the width of said cross-bottom.

* * * * *